US007824607B2

(12) United States Patent
Kajihara et al.

(10) Patent No.: US 7,824,607 B2
(45) Date of Patent: Nov. 2, 2010

(54) ALUMINUM ALLOY SHEET

(75) Inventors: Katsura Kajihara, Kobe (JP); Takeshi Kudo, Kobe (JP); Yasuhiro Aruga, Kobe (JP); Katsushi Matsumoto, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 163 days.

(21) Appl. No.: 11/957,825

(22) Filed: Dec. 17, 2007

(65) Prior Publication Data

US 2008/0175747 A1 Jul. 24, 2008

(30) Foreign Application Priority Data

Jan. 18, 2007 (JP) ..... 2007-009292

(51) Int. Cl.

| | |
|---|---|
| ***C22C 21/00*** | (2006.01) |
| *C22C 21/02* | (2006.01) |
| *C22C 21/06* | (2006.01) |
| *C22C 21/12* | (2006.01) |

(52) U.S. Cl. ..... 420/532; 420/534; 420/535; 148/439

(58) Field of Classification Search ..... 420/532, 420/534, 535; 148/439

See application file for complete search history.

(56) References Cited

U.S. PATENT DOCUMENTS

| | | | | |
|---|---|---|---|---|
| 6,231,809 | B1 | 5/2001 | Matsumoto et al. | |
| 6,334,916 | B1 | 1/2002 | Matsumoto et al. | |
| 2004/0187985 | A1 | 9/2004 | Matsumoto et al. | |
| 2006/0078755 | A1 * | 4/2006 | Benedictus et al. | 428/654 |

FOREIGN PATENT DOCUMENTS

| | | |
|---|---|---|
| DE | 199 38 995 A1 | 3/2001 |
| JP | 10-219382 | 8/1998 |
| JP | 2000-273567 | 10/2000 |
| JP | 2003-27170 | 1/2003 |
| JP | 2005-526901 | 9/2005 |

OTHER PUBLICATIONS

U.S. Appl. No. 12/090,879, filed Apr. 21, 2008, Kajihara, et al.

* cited by examiner

*Primary Examiner*—Jerry Lorengo
*Assistant Examiner*—Rebecca Lee
(74) *Attorney, Agent, or Firm*—Oblon, Spivak, McClelland, Maier & Neustadt, L.L.P.

(57) ABSTRACT

Disclosed is an aluminum alloy sheet resistant to deterioration through natural aging. The aluminum alloy sheet is an Al—Mg—Si aluminum alloy sheet containing 0.35 to 1.0 percent by mass of magnesium; 0.5 to 1.5 percent by mass of silicon; 0.01 to 1.0 percent by mass of manganese; and 0.001 to 1.0 percent by mass of copper, with the remainder being aluminum and inevitable impurities, in which the amount of dissolved silicon is 0.55 to 0.80 percent by mass, the amount of dissolved magnesium is 0.35 to 0.60 percent by mass, and the ratio of the former to the latter is 1.1 to 2. The aluminum alloy sheet may further contain 0.005 to 0.2 percent by mass of titanium with or without 0.0001 to 0.05 percent by mass of boron.

11 Claims, 1 Drawing Sheet

ALUMINUM ALLOY SHEET

FIELD OF THE INVENTION

The present invention relates to aluminum alloy sheets. Specifically, it relates to Al—Mg—Si aluminum alloy sheets (aluminum is hereinafter also simply referred to as Al) which are excellent in paint bake hardenability and bendability (typified by hemmability (hem workability)) and excellent in room temperature stability (natural aging resistance). The term "room temperature stability" herein refers to resistance to deterioration in properties through natural aging (deterioration in formability and bendability due to increased strength). One excellent in room temperature stability is resistant to deterioration in properties through natural aging, namely, varies less in properties at room temperature with time.

BACKGROUND OF THE INVENTION

For solving global environmental issues caused by exhaust gases, bodies of transportation machines such as automobiles should have lighter weights so as to improve fuel efficiencies. Accordingly, aluminum alloy materials have been increasingly used in automotive bodies instead of previously-used steel materials, because such aluminum alloy materials have lighter weights and are excellent in formability and paint bake hardenability.

Among them, AA 6000 or JIS 6000 series (hereinafter simply referred to as "6000 series") Al—Mg—Si aluminum alloy sheets have been adopted as thin-thickness high-strength aluminum alloy sheets to panels such as outer panels and inner panels of automotive panel structures including hoods, fenders, doors, roofs, and trunk lids.

Such 6000 series aluminum alloy sheets basically essentially contain silicon and magnesium and have excellent age hardenability. When they are subjected to press forming or bending, they show lower yield strength and thereby have sufficient formability. In addition, they have bake hardenability (artificial age-hardenability or paint bake hardenability). Specifically, when they are heated at relatively low temperatures in artificial aging (hardening) such as paint baking of panels after forming, they undergo age hardening to have increased yield strength to thereby show sufficient strength.

The 6000 series aluminum alloy sheets contain relatively smaller amounts of alloy elements than those of, for example, 5000 series aluminum alloy sheets containing larger amounts of alloy elements such as magnesium. When the 6000 series aluminum alloy sheets are reused in the form of scraps as aluminum alloy melting materials (melting raw materials), ingots of 6000 series aluminum alloys can be easily obtained therefrom. Thus, they are also excellent in recyclability.

On the other hand, automotive outer panels are produced by subjecting aluminum alloy sheets to plural forming processes such as bulging and bending in press forming. In the formation of large-size outer panel structures such as hoods and doors, aluminum sheets are subjected to press forming such as bulging to yield formed articles as outer panels, and these outer panels are joined with inner panels to form panel structures by hemming such as flat hemming on the periphery of outer panels.

In this process, the 6000 series aluminum alloy sheets undergo natural aging. In particular, when they undergo natural aging for about three months to six months, they have markedly lowered paint bake hardenability and bendability due to increased yield strength and formation of atomic clusters.

For inhibiting deterioration in properties through natural aging and for improving room temperature stability, there have been made proposals to control atomic clusters, in particular, to control clusters of magnesium and silicon atoms which are formed when the aluminum alloy sheets are left at room temperature after solution heat treatment and quenching treatment.

For improving paint bake hardenability, for example, JP-A No. 2005-139537 relates to a technique of controlling a cooling rate in a solution heat treatment while focusing attention on a peak height in a differential thermal analysis curve. JP-A No. 10 (1998)-219382 and JP-A No. 2000-273567 relate to techniques for avoiding clusters of magnesium and silicon atoms (clusters of silicon and vacancy atom, Guinier-Preston 1 zone (GPI zone)). JP-A No. 2003-27170 relates to a technique of avoiding clusters of silicon and vacancy atom with respect to peaks in differential scanning calorimetry (DSC).

SUMMARY OF THE INVENTION

These known techniques for inhibiting deterioration in properties through natural aging and for improving room temperature stability are based on, for example, pattern control of conditions for a solution heat treatment or addition of a heat treatment such as a reversion treatment (heat treatment carried out after solution heat treatment). However, techniques based on pattern control of conditions for a solution heat treatment cause decreased productivity, and techniques based on addition of a heat treatment such as a reversion treatment require an extra annealing step and thereby increased cost.

Under these circumstances, an object of the present invention is to provide an aluminum alloy sheet which is excellent in room temperature stability and resistant to deterioration in properties through natural aging.

After intensive investigations by the present inventors, the present invention has been made. Specifically, there is provided an aluminum alloy sheet which is excellent in room temperature stability and resistant to deterioration in properties through natural aging.

Specific embodiments of the aluminum alloy sheet are as follows.

Specifically, according to an embodiment of the present invention, there is provided an aluminum alloy sheet as an Al—Mg—Si aluminum alloy sheet which contains 0.35 to 1.0 percent by mass of magnesium (Mg); 0.5 to 1.5 percent by mass of silicon (Si); 0.01 to 1.0 percent by mass of manganese (Mn); and 0.001 to 1.0 percent by mass of copper (Cu), with the remainder being aluminum (Al) and inevitable impurities, in which the amount of dissolved silicon (Si) is 0.55 to 0.80 percent by mass, the amount of dissolved magnesium (Mg) is 0.35 to 0.60 percent by mass, and the ratio of the amount of dissolved silicon (Si) to the amount of dissolved magnesium (Mg) is 1.1 to 2.

In another embodiment, the aluminum alloy sheet may be an excess-silicon Al—Mg—Si aluminum alloy sheet having a ratio by mass of the silicon content to the magnesium content of 1 or more.

According to another embodiment, the aluminum alloy sheet may contain, as the inevitable impurities, 1.0 percent by mass or less of iron (Fe); 0.3 percent by mass or less of chromium (Cr); 0.3 percent by mass or less of zirconium (Zr); 0.3 percent by mass or less of vanadium (V); 0.1 percent by mass or less of titanium (Ti); 0.2 percent by mass or less of silver (Ag); and 1.0 percent by mass or less of zinc (Zn).

The aluminum alloy sheet may contain, according to yet another embodiment, 0.005 to 0.2 percent by mass of titanium (Ti) with or without 0.0001 to 0.05 percent by mass of boron (B).

Such an aluminum alloy sheet according to an embodiment of the present invention may be produced by homogenizing an aluminum alloy ingot, cooling the homogenized ingot, reheating the cooled ingot, hot rolling the reheated ingot, and cold rolling the hot-rolled product without annealing.

In a preferred embodiment, rough rolling in the hot rolling may be carried out at a start temperature of 490° C. to 380° C. and a finish temperature of 430° C. to 350° C. for 10 minutes or less.

Such aluminum alloy sheets according to embodiments of the present invention may be used in automotive outer panels.

Aluminum alloy sheets according to embodiments of the present invention are excellent in room temperature stability and resistant to deterioration in properties through natural aging.

DETAILED DESCRIPTION OF THE PREFERRED EMBODIMENTS

Figure 1:
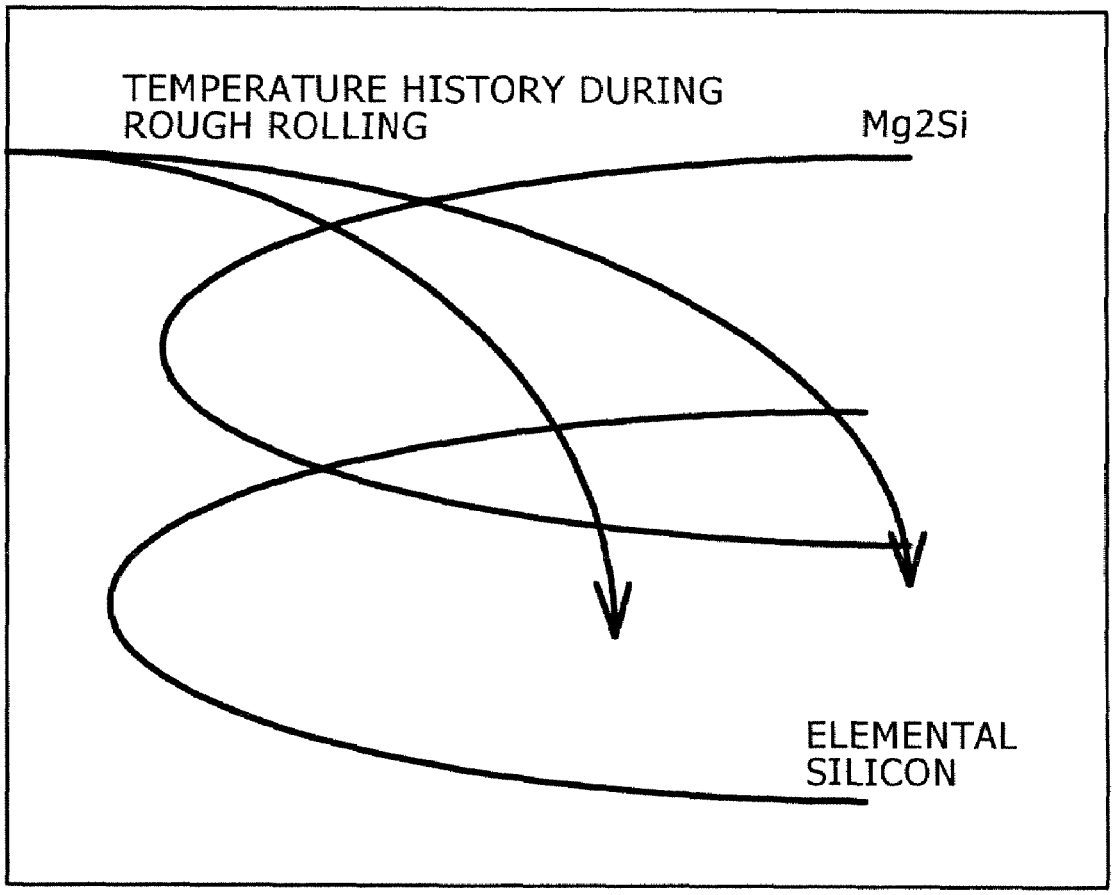
FIG. 1 is a schematic view showing temperature histories which intersect precipitation curves of precipitates of $Mg_2Si$ and elemental silicon.

Although a variety of theories has been proposed about the mechanism of natural aging, it is believed that the formation of magnesium-silicon (Mg—Si) nanoclusters is involved in natural aging. After intensive investigations on solid-solution and precipitation conditions for yielding aluminum alloy sheets which are excellent in room temperature stability, the present inventors have found that the increase in strength can be inhibited, and thereby lowering in formability, bendability and bake hardenability can be inhibited even after holding aluminum alloy sheets at room temperature over a long period of time, by controlling the balance between the amount of dissolved silicon and the amount of dissolved magnesium.

Reasons for specifying parameters of aluminum alloy sheets according to embodiments of the present invention will be described below.

Amount of Dissolved Silicon and Amount of Dissolved Magnesium

Aged deterioration (increase in strength during storage at room temperature) in 6000 series aluminum alloys is presently academically considered to be caused by Mg—Si, Si—Si, and Mg—Mg nanoclusters which are formed during storage at room temperature from magnesium and silicon atoms dissolved in aluminum matrix.

These phenomena tend to occur more likely with increasing amounts of dissolved magnesium and dissolved silicon. Accordingly, the upper limits in amounts of these dissolved elements should be specified.

However, automotive panel materials containing 6000 series aluminum alloys should have bake hardenability. Accordingly, the lower limits in amounts of the dissolved elements should also be specified for ensuring minimum bake hardenability (strength after baking).

From these points, the amount of dissolved silicon is set at 0.55 to 0.80 percent by mass and the amount of dissolved magnesium is set at 0.35 to 0.60 percent by mass ("percent by mass" is hereinafter also simply referred to as "%"). If these contents exceed their upper limits, aged deterioration tend to occur. The amount of dissolved silicon is preferably 0.78% or less, and the amount of dissolved magnesium is preferably 0.55% or less. In contrast, if these amounts are lower than their lower limits, it is difficult to ensure bake hardenability (strength after baking. The amount of dissolved silicon is preferably 0.6% or more, and the amount of dissolved magnesium is preferably 0.38% or more.

Ratio of Dissolved Silicon Amount to Dissolved Magnesium Amount

After further investigations on the mechanism of aged deterioration, the present inventors have found that aged deterioration is not sufficiently inhibited by merely specifying the amounts of the dissolved elements, and that, for inhibiting aged deterioration sufficiently, the ratio of the amount of dissolved silicon to the amount of dissolved magnesium should be properly control. Although its mechanism still remains partially unknown, aged deterioration is inhibited at a proper ratio of the amount of dissolved silicon to the amount of dissolved magnesium probably because magnesium and silicon substantially dissolved in aluminum matrix become a form resistant to the formation of Mg—Si clusters or become a form which yields Mg—Si clusters but at a lower rate during storage at room temperature.

The proper ratio of the amount of dissolved silicon to the amount of dissolved magnesium is 1.1 to 2. Namely, the ratio of the amount of dissolved silicon to the amount of dissolved magnesium should be set at 1.1 to 2. If the ratio of the amount of dissolved silicon to the amount of dissolved magnesium is less than 1.1, the strength after baking may be insufficient. In contrast, if it exceeds 2, aged deterioration may occur undesirably. The ratio is more preferably 1.2 or more and/or 1.8 or less.

In knowledge of before, aged deterioration is controlled by adjusting the amounts of magnesium and silicon, and the ratio between them. However, aged deterioration is not sufficiently inhibited therein. In such known materials, the ratio of the amount of dissolved silicon to the amount of dissolved magnesium is generally more than 2, thus causing aged deterioration.

Chemical Composition

When used typically as sheets for automotive outer panels, aluminum alloy sheets should be excellent in properties such as formability, bake hardenability, strength, weldability, and corrosion resistance. To satisfy these, aluminum alloy sheets according to embodiments of the present invention contain 0.35 to 1.0 percent by mass of magnesium (Mg); 0.5 to 1.5 percent by mass of silicon (Si); 0.01 to 1.0 percent by mass of manganese (Mn); and 0.001 to 1.0 percent by mass of copper (Cu), with the remainder being aluminum (Al) and inevitable impurities.

In general, 6000 series aluminum alloy sheets often suffer from ridging marks. In a preferred embodiment according to the present invention, an excess-silicon 6000 series aluminum alloy sheet having a ratio by mass of the silicon content to the magnesium content (Si/Mg) of 1 or more is employed. Specifically, an aluminum alloy sheet according to an embodiment of the present invention is preferably an excess-silicon Al—Mg—Si aluminum alloy sheet having a ratio by mass of the silicon content to the magnesium content of 1 or more. The 6000 series aluminum alloy sheets have lower yield strength to thereby ensure satisfactory formability during press forming or bending. In addition, they have excellent age hardenability (bake hardenability). Specifically, when they are subjected to heating at relatively low temperatures in an artificial aging treatment such as paint baking of panels after forming, they undergo age hardening to have increased yield strength to thereby ensure satisfactory strength. Among these 6000 series aluminum alloy sheets, excess-silicon 6000 series aluminum alloy sheets have superior bake hardenability to that of 6000 series aluminum alloy sheets having a ratio by mass of the silicon content to the magnesium content (Si/Mg) of less than 1.

Other elements than aluminum, magnesium, silicon, manganese, and copper are basically impurities, and their contents should be equal to or lower than allowable amounts of respective impurities according typically to Aluminum Association Standards (AA Standards) or Japanese Industrial Standards (JIS). However, from the viewpoint of material recycling, large amounts of scraps of aluminum alloys such as 6000 series aluminum alloys and low-purity aluminum ingots may be used as melting materials in addition to high-purity aluminum ingots. In this case, raw material aluminum alloys obtained therefrom may contain relatively large amounts of impurity elements. If these impurity elements must be reduced to, for example, detection limits or less, this causes increased cost. Accordingly, aluminum alloy sheets are allowed to contain these impurities to some extent. In addition, within some contents, the impurity elements do not adversely affect advantages of the present invention but rather exhibit some effects. From these viewpoints, an aluminum alloy sheet according to an embodiment of the present invention may contain the impurity elements within the following ranges.

Specifically, the aluminum alloy sheet may contain 1.0 percent by mass or less of iron (Fe); 0.3 percent by mass or less of chromium (Cr); 0.3 percent by mass or less of zirconium (Zr); 0.3 percent by mass or less of vanadium (V); and 0.1 percent by mass or less of titanium (Ti) and may contain, instead of or in addition to these elements, 0.2 percent by mass or less of silver (Ag); and 1.0 percent by mass or less of zinc (Zn).

Effects and reasons for limitations of alloy components (Si, Mg, Cu, and Mn) in an aluminum alloy sheet according to an embodiment of the present invention will be described below.

Silicon content: 0.5% to 1.5%

Silicon (Si) element is essential for obtaining required properties as an automotive outer panel, such as yield strength of 170 MPa or more, as with magnesium. Specifically, silicon contributes to solid-solution hardening and age hardenability, because silicon forms, together with magnesium, precipitates through aging (hereinafter also referred to as "aged precipitates") during an artificial aging treatment at relatively low temperatures, such as paint baking, and these aged precipitates increase strength. Silicon is therefore a key element for allowing an excess-silicon 6000 series aluminum alloy sheet according to an embodiment of the present invention to have properties such as press formability and hemmability at satisfactory levels.

In a preferred embodiment, an aluminum alloy sheet preferably has a ratio by mass of the silicon content to the magnesium content (Si/Mg) of 1 or more, so as to have a composition as an excess-silicon 6000 series aluminum alloy which contains silicon excess to magnesium. Such an excess-silicon 6000 series aluminum alloy can exhibit excellent low-temperature age hardenability, and when the aluminum alloy sheet is formed into a panel, the panel has a yield strength after low-temperature paint baking of 170 MPa or more. The strength herein is determined, for example, after applying 2% stretch to the aluminum alloy sheet and subjecting the aluminum alloy sheet to an aging treatment at 170° C. for 20 minutes.

If the silicon content is less than 0.5%, the aluminum alloy sheet may have insufficient age hardenability and are insufficient in required properties such as press formability and hemmability. In contrast, if the silicon content is more than 1.5%, the aluminum alloy sheet may have insufficient hemmability and press formability, and decreased weldability. Accordingly, the silicon content is set at 0.5% to 1.5%. A preferred lower limit of the silicon content is 0.6%. When used as an automotive outer panel, a preferred upper limit of the silicon content is 1.2% for further improving hemmability as well as press formability, because hemmability is specifically important in such an automotive outer panel. The silicon content is preferably set within a relatively low range of, for example, 0.6% to 1.2%.

Magnesium Content: 0.35% to 1.0%

Magnesium (Mg) element is essential for obtaining required properties as an automotive outer panel, such as yield strength of 170 MPa or more, as with silicon. Specifically, magnesium contributes to solid-solution hardening and age hardenability, because silicon forms, together with silicon, aged precipitates during an artificial aging treatment at relatively low temperatures, such as paint baking, and these aged precipitates increase strength.

If the magnesium content is less than 0.35%, the absolute amount of magnesium is insufficient, and the aged precipitates (compound phase) may not be formed and age hardenability may not be exhibited during an artificial aging treatment. Accordingly, it is difficult to have a yield strength of 170 MPa or more necessary as a panel. In contrast, if the magnesium content exceeds 1.0%, formabilities such as press formability and bendability may be decreased. Accordingly, the magnesium content is set at 0.35% to 1.0%. To yield a composition as an excess-silicon 6000 series aluminum alloy, the magnesium content may be set at such a content that the ratio by mass of the silicon content to the magnesium content is 1 or more. When the silicon content is set within a relatively low range of 0.6% to 1.2% for further improving hemmability, the upper limit of the magnesium content is preferably 0.7%, and the magnesium content is preferably within a relatively low range of, for example, 0.2% to 0.7% so as to allow the aluminum alloy sheet to have a composition as an excess-silicon 6000 series aluminum alloy.

Copper Content: 0.001% to 1.0%

Copper (Cu) accelerates the formation of aged precipitates in grains in an aluminum alloy microstructure during an artificial aging treatment at relatively low temperatures for a relatively short period of time. Such aged precipitates contribute to increased strength. In addition, dissolved copper also improves formability. If the copper content is less than 0.001%, these advantages may not be sufficiently exhibited. In contrast, if the copper content exceeds 1.0%, resistance to stress corrosion cracking, filiform rust resistance as corrosion resistance after painting, and weldability may be decreased. When the aluminum alloy sheet is used as a constructional material in which corrosion resistance is important, the copper content is preferably 0.8% or less.

Manganese Content: 0.01% to 1.0%

Manganese (Mn) acts to form fine grains, because this element forms dispersed particles (dispersed phase) during homogenization, and these dispersed particles inhibit grain boundaries from migrating after recrystallization. An aluminum alloy sheet according to an embodiment of the present invention may have improved press formability and hemmability with increasing fineness of grains in the aluminum alloy microstructure. These advantages may not be sufficiently obtained if the manganese content is less than 0.01%. In contrast, if the manganese content is excessively high, the element is likely to form coarse Al—Fe—Si—(Mn, Cr, Zr) intermetallic compounds and crystallized precipitates during melting and casting, and causes the aluminum alloy sheet to have decreased mechanical properties. Accordingly, the manganese content is set at 0.01% to 1.0%.

Flat hemming should be carried out under tight working conditions when the target article has a complicated shape or has a small thickness, or there is a gap between the edge of an inner panel and the curved inner surface of a corresponding outer panel. If an aluminum alloy sheet having a manganese content exceeding 0.15% is subjected to flat hemming under such tight working conditions, hemmability may be decreased. Accordingly, the manganese content is preferably 0.01% to 0.15% when subjected to flat hemming under tight working conditions.

The aluminum alloy microstructure practically preferably has a smaller average grain size so as to yield satisfactory bendability. Such bendability is major one of properties that deteriorate due to aging. Specifically, average grain sizes at two points in the aluminum alloy sheet are preferably 45 μm or less, respectively, in which the two points are a point in a center part in a thickness direction of the sheet and an optional point in a surface layer locating between the outermost surface and one fourth deep in a thickness direction of the sheet. In other words, when average grain sizes are controlled not only in the outermost layer but also in the center part of the sheet, satisfactory bendability may be obtained and ridging marks may be effectively inhibited.

By reducing grain sizes to this range, bendability and press formability may be ensured or improved. If grains become coarse to have grain sizes exceeding 45 μm, bendability and press formability such as bulging workability may be decreased to cause occurrence of defects, such as cracking and orange peel surfaces, during forming even when crystal orientation is controlled.

The "average grain size" herein is determined by measuring largest diameters of respective grains observed in a predetermined measuring region of a scanning electron microscope-electron backscattered pattern analyzer (SEM-EBSP) under specific measuring conditions, and calculating the average of measured largest diameters.

Finer grains may be obtained by adding titanium (Ti) with or without boron (B) to an aluminum alloy, in addition to Si, Mg, Cu, and Mn. Specifically, an aluminum alloy sheet according to an embodiment of the present invention may further contain 0.005 to 0.2 percent by mass of titanium (Ti) with or without 0.0001 to 0.05 percent by mass of boron (B), in addition to Si, Mg, Cu, and Mn.

Titanium (Ti) element makes grains finer. Between titanium and boron, titanium is more effective and more preferred for exhibiting this advantage. The titanium content, if contained, is preferably 0.005% or more, more preferably 0.01% or more, and further preferably 0.015% or more. The upper limit of the titanium content is preferably 0.2%, more preferably 0.1%, and further preferably 0.05%. This is because, if titanium is contained in excess, coarse Al—Ti intermetallic compounds crystallize out and adversely affect formability.

The aluminum alloy sheet may contain titanium alone between titanium and boron but may contain titanium with a trace amount of boron. When the aluminum alloy sheet further contains boron in addition to titanium, grains may become further finer effectively. In this case, the boron content is 0.0001% or more, more preferably 0.0005% or more, and further preferably 0.0008% or more. The upper limit of the boron content is preferably 0.05%, more preferably 0.01%, and further preferably 0.005%. This is because, if boron is contained in excess, coarse Ti—B particles may form and thereby adversely affect formability.

Inevitable impurities are preferably contained as less as possible not to adversely affect properties of aluminum alloy sheets. However, these may be contained in amounts up to their allowable limits as respective elements in 6000 series aluminum alloy specified in, for example, Japanese Industrial Standards, within ranges not adversely affecting the properties of the aluminum alloy sheets.

Such aluminum alloy sheets may be produced by a process which includes homogenizing an aluminum alloy ingot, cooling the homogenized ingot, reheating the cooled ingot, hot rolling the reheated ingot, and cold rolling the hot-rolled product without annealing.

According to this process, aluminum alloy sheets can be efficiently produced in commercial production, because the process can employ relatively large-size ingots, and cold rolling is conducted without annealing after hot rolling. In addition, the product aluminum alloy sheets are prevented from occurrence of ridging marks, because material ingots are homogenized, once cooled, then reheated, and hot-rolled.

The process of producing an aluminum alloy sheet will be illustrated in detail below.

Melting and Casting

In a melting-casting step, an aluminum alloy is melted to have a composition within specific compositions as 6000 series aluminum alloys, and the molten metal is cast according to a common melting-casting procedure such as continuous casting rolling or semicontinuous casting (direct-chill casting (DC casting)).

Homogenization

Next, the cast aluminum alloy ingot is homogenized. The homogenization is carried out according to a common procedure at a suitable temperature of 500° C. or higher and lower than the melting point of the aluminum alloy. The homogenization is conducted for homogenizing the ingot microstructure, namely, for eliminating segregation in grains of the ingot microstructure. If the homogenization temperature is excessively low, segregation in grains may not be sufficiently eliminated, and the residual segregation may cause breakage and thereby adversely affect stretch flangeability and bendability.

The aluminum alloy ingot after the first homogenization is once cooled to a temperature of 350° C. or lower, e.g., room temperature, and reheated to a start temperature of hot rolling of 380° C. to 490° C., followed by hot rolling (rough hot rolling). This procedure of carrying out first homogenization, cooling, and reheating is hereinafter also referred to as "double homogenization".

The cooling after the homogenization (first homogenization) is preferably conducted at a cooling rate of 40° C./hr or more and 100° C./hr or less. By conducting cooling at a cooling rate within the specific range, particles of $Mg_2Si$ compounds in the ingot can have sizes and distribution suitable as nucleation sites for grains recrystallized during hot rolling, even in a hot rolling line for commercial production. As a result, occurrence of coarse recrystallized grains (hot fibers) during hot rolling can be inhibited, the microstructure after recrystallization can be homogenized, and occurrence of ridging marks during forming can be prevented even in an excess-silicon 6000 series aluminum alloy sheet.

An actual ingot (slab) has a large size of a thickness of 400 to 600 mm, a width of 1000 to 2500 mm, and a length of 5 to 10 m. Accordingly, the cooling rate after homogenization is less than about 20° C./hr in a batch soaking pit (holding furnace), and even when the ingot is left stand outside the furnace, the cooling rate is at most about 30° C./hr to 40° C./hr. If cooling is conducted according to such a common cooling procedure, the cooling rate is insufficient and precipitates such as $Mg_2Si$ compounds become large. This results in decrease in strength, bake hardenability (yield strength after bake hardening), and bendability in the step of carrying out double homogenization.

When relatively large-size ingots having a thickness of about 400 mm or more are cooled after homogenization, the ingot should be cooled by forced air cooling with fans in a soaking pit or outside thereof so as to cool at a cooling rate within the specific range of 40° C./hr or more and 100° C./hr or less. The forced air cooling in this case is carried out in the soaking pit or outside thereof by arranging fans according to the size and arrangement of the ingots so as to homogeneously cool the ingots at a cooling rate within the specific range. In contrast, when relatively large-size ingots having a thickness of about 400 mm or more are radiationally cooled in a soaking pit or outside thereof without using fans, they are cooled at an excessively low cooling rate. The cooling rate in this case is inevitably less than the lower limit of 40° C./hr.

JP-A No. 8 (1996)-232052 and JP-A No. 7 (1995)-228956 disclose a technique of cooling an ingot after homogenization at a cooling rate of, for example, 100° C./hr or more or 150° C./hr or more. Such a high cooling rate can be achieved in small-size ingots, but is rather difficult to achieve in relatively large-size ingots having a thickness of about 400 mm or more as mentioned above. If a large-size ingot is cooled at such a high cooling rate, it must be cooled by an extra forced cooling procedure including water cooling such as mist cooling or spray cooling. This forced cooling procedure may cause additional problems in shape due to thermal shrinkage, such as deformation and warpage.

Hot Rolling

For commercial production, hot rolling is preferably conducted on a relatively large-size ingot in a hot rolling line, in which the hot rolling line includes a reverse rough rolling machine and tandem finish rolling machines. The hot rolling line generally includes one reverse rough rolling machine and three to five tandem finish rolling machines. Rolling processes each composed of two or more passes are conducted in these rough rolling machine and finish rolling machines, respectively.

Control of the specific amount of dissolved silicon, amount of dissolved magnesium, and ratio of the amount of dissolved silicon to the amount of dissolved magnesium will be illustrated below.

Assume that an aluminum alloy sheet is prepared by homogenizing an aluminum alloy ingot, cooling, reheating, hot rolling, and cold rolling without annealing, and the aluminum alloy sheet is subjected to a solution heat treatment/reheating step. In this case, the amounts of solid solutions in the resulting aluminum alloy sheet (final sheet) are determined by: (i) conditions of precipitates after homogenization (soaking) and before hot rolling; (ii) the sizes of Mg—Si precipitates, the amount of dissolved magnesium, and the amount of dissolved silicon after hot rolling; and (iii) the amount of re-dissolved Mg—Si precipitates which have remained in the hot-rolled sheet before cold rolling, in which the amount of re-dissolved Mg—Si precipitates varies depending on conditions for the solution heat treatment.

The solution heat treatment/reheating is preferably carried out under after-mentioned recommended conditions. However, it is difficult to completely re-dissolve precipitates from the view point of productivity in an actual production process, and control by the above-mentioned parameter (iii) is limited.

Accordingly, it is important to control the size distribution of precipitates in the hot-rolled sheet, for achieving the specific amounts of dissolved elements specified.

For controlling the size distribution, rough hot rolling in the hot rolling step is preferably conducted at a rate higher than that in a regular temperature history. This is based on how the temperature of a site varies depending on the elapsed time during rough hot rolling. Specifically, a temperature history intersecting a precipitation curve of $Mg_2Si$ precipitates and a precipitation curve of elemental silicon precipitate is preferably shortened. The precipitation curves and temperature histories are illustrated in FIG. 1 by way of example.

After intensive investigations and experiments, the present inventors have found that the size distribution of Mg—Si precipitates varies depending on a temperature history from the start to the finish of rough rolling, and that the amounts of solid solutions in a final product can be controlled by controlling the temperature history.

Specifically, by setting the rolling time in rough rolling to be shorter than that in common rough rolling, the ratio of the amount of dissolved silicon to the amount of dissolved magnesium can be controlled to 2 or less, whereby aged deterioration in properties at room temperature can be inhibited. This is probably for the following reason.

Basically, the nose of precipitation curve of $Mg_2Si$ precipitates is located at a higher temperature than that of elemental silicon precipitate, and the amount of dissolved magnesium tends to decrease due to precipitation in this region in an aluminum alloy sheet having the specific composition. In addition, elemental silicon tends to precipitate in an increased amount at intermediate temperatures in rough rolling. Accordingly, by shortening the rolling time of rough rolling, precipitation at higher temperatures is accelerated, the size of formed $Mg_2Si$ precipitates is decreased, and the amount of dissolved magnesium at a sufficient level is obtained. Thus, the ratio of the amount of dissolved silicon to the amount of dissolved magnesium is controlled to 2 or less.

The rough rolling is preferably carried out at a start temperature of 490° C. to 380° C. and a finish temperature of 430° C. to 350° C. for a rolling time between the start and the end of 10 minutes or less. If the start temperature of rough rolling exceeds 490° C., precipitates may become coarse. In contrast, if it is lower than 380° C., elemental silicon precipitate increases. The start temperature of rough rolling is more preferably 450° C. to 380° C. The rolling time is more preferably 9 minutes or less. When the start temperature of rough rolling is set at around 490° C., the rolling time is preferably 8 minutes or less, because the precipitation rate increases with an elevating temperature. In this connection, the rolling time in a known rough rolling procedure is about 15 minutes, whereby solid solutions in amounts in a good balance (with a good ratio) may not be obtained.

Recommended conditions and parameters of aluminum alloy sheets for improving bendability and for inhibiting occurrence of ridging marks will be illustrated below.

Control of Grain Size

The following conditions are preferred for yielding desired grain sizes at two points, in which the two points are a point in a center part in a thickness direction of the sheet and an optional point in a surface layer locating between the outermost surface and one fourth deep in a thickness direction of the sheet. Specifically, it is desirable that rough rolling in the hot rolling step is conducted at a start temperature of 350° C. to 500° C., finish rolling in the hot rolling step is conducted at a total reduction ratio of 90% or more and at a finish temperature of 350° C. or lower, and the sheet is coiled at an average tension of 20 MPa or more.

If the start temperature of rough rolling in the hot rolling step is lower than 350° C., recrystallization after hot rolling may not sufficiently proceed and a deformation texture may grow to thereby cause occurrence of ridging marks. In contrast, if the start temperature of rough rolling exceeds 500° C., recrystallization may occur during hot rolling to form coarse recrystallized grains, whereby recrystallized grains of crystal orientation components may often be aligned streaky to cause ridging marks.

If the finish temperature of finish rolling in the hot rolling step exceeds 350° C., coarse recrystallized grains may be likely to occur, whereby recrystallized grains in a specific orientation of the sheet are aligned streaky. This may also occur when the average tension during coiling of the sheet is less than 20 MPa.

If the finish temperature of finish rolling is lower than 280° C., recrystallization after hot rolling may not sufficiently proceed and a deformation texture may grow to thereby cause occurrence of ridging marks. Accordingly, the finish temperature of finish rolling in the hot rolling step is preferably 280° C. or higher and 350° C. or lower.

Annealing of Hot-Rolled Sheet

Annealing (intermediate annealing) of the hot-rolled sheet before cold rolling is preferably not conducted, for higher production efficiency and for lower production cost.

Cold Rolling

The hot-rolled sheet is subjected to cold rolling to yield a cold-rolled sheet (including a coil) having a desired thickness.

Solution Heat Treatment and Quenching Treatment

Dispersed particles (dispersed grains) formed as a result of the homogenization (soaking) of the aluminum alloy ingot have controlled sizes and distribution suitable as nucleation sites for grains which are recrystallized during hot rolling. These dispersed particles are preferably used as recrystallization nuclei to yield recrystallized crystals having random orientations, so as to prevent occurrence of ridging marks during final solution heat treatment and quenching treatment. For this purpose, the final solution heat treatment is preferably carried out at a rate of temperature rise of 100° C./minute or more. The dispersed particles act as nuclei for forming recrystallized crystals having random orientations during such a temperature rise process at a rate of 100° C./minute or more in the final solution heat treatment. The rate of temperature rise in the final solution heat treatment is more preferably 200° C./minute or more, and further preferably 300° C./minute or more.

The solution heat treatment is preferably carried out at a temperature equal to or higher than 500° C. and equal to or lower than the melting point of the alloy. Thus, aged precipitates sufficiently precipitate in the grains through an artificial aging treatment after press forming of the sheet, such as paint bake hardening treatment. These precipitates contribute to higher strength.

If a quenching treatment from the temperature of solution heat treatment is conducted at a low cooling rate, silicon, $Mg_2Si$, and other particles may be likely to precipitate at grain boundaries, cause cracking during press forming and bending, whereby formability is decreased. To avoid this, the quenching treatment is preferably carried out at a high cooling rate of 10° C./second or more by using a suitable cooling procedure under suitable cooling conditions. Such cooling procedures include air cooling procedures such as cooling with fans, and water cooling procedures such as mist cooling, spray cooling, and dipping in water.

A preaging treatment may be carried out after the quenching treatment, for accelerating precipitation of aged precipitates which contribute to higher strength. Thus, age hardenability during an artificial aging treatment typically in a paint baking step of a formed panel can further be increased. The preaging treatment is preferably carried out by holding the article at temperatures within ranges of 60° C. to 150° C., preferably 70° C. to 120° C., for 1 to 24 hours. When the preaging treatment is carried out, it is desirable that the precedent quenching treatment is carried out at a high cooling finish temperature of 60° C. to 150° C., and that the article is subjected to the preaging treatment with or without reheating immediately after the completion of the quenching treatment (after the completion of cooling). It is also desirable that an article after the solution heat treatment is subjected to a quenching treatment to room temperature, reheated to 60° C. to 150° C. immediately (within 5 minutes) after the completion of the quenching treatment, and subjected to the preaging treatment.

In addition, a heat treatment (artificial aging treatment) at relatively low temperature may be carried out immediately after the preaging treatment, for inhibiting natural aging. If there is some delay between the preaging treatment and the artificial aging treatment start, natural aging may occur with time even after the preaging treatment. Once natural aging occurs, it is difficult to exhibit advantages of the heat treatment at relatively low temperatures (artificial aging treatment).

When a continuous solution heat/quenching treatment is carried out, the quenching treatment may be completed at a high finish temperature within the range of the preaging temperatures, and the article may be coiled while holding at the high temperature. In this case, the article may be reheated before coiling and/or the article may be held at the temperature after coiling. It is also acceptable that the article is subjected to a quenching treatment to room temperature, the quenched article is reheated to the temperature range, and coiled at such high temperature.

It is also possible to further increase strength by carrying out an aging treatment at high temperatures and/or a stabilizing treatment according to the use and required properties of the final product.

Some embodiments of the present invention will be illustrated in further detail with reference to examples and comparative examples below. However, these examples are illustrated only by example and never construed to limit the scope of the present invention. It should be understood by those skilled in the art that various modifications, combination, sub-combinations, and alternations may occur depending on design requirements and other factors insofar as they are within the scope of the appended claims or the equivalents thereof.

EXPERIMENTAL EXAMPLE

Ingots of aluminum alloys were homogenized, hot-rolled, cold-rolled, subjected to a solution heat treatment and a quenching treatment under conditions shown in Table 2, and thereby yielded 6000 series aluminum alloy sheets having compositions A to M shown in Table 1. The symbol "–" in the contents of respective elements in Table 1 means that the content in question is below the detection limit.

The detailed production conditions of the aluminum alloy sheets are as follows. Specifically, ingots of aluminum alloys having compositions shown in Table 1 and having a thickness of 500 mm, a width of 2000 mm, and a length of 7 m were cast according to DC casting. These ingots were subjected to a double homogenization, except for apart thereof (Sample No. 10). Sample No. 10 was subjected to a single homogenization at 550° C. for 4 hours, and rough rolling in hot rolling was started at this temperature immediately after the homogenization without cooling.

In the double homogenization, the ingots were homogenized (first homogenization) at 550° C. for 4 hours, and the homogenized ingots were forcedly air-cooled to a temperature of 200° C. or lower at a cooling rate of 60° C./hr in a soaking pit using fans. The cooled ingots were reheated to 400° C., and rough rolling in hot rolling was started at this temperature.

The ingots were then hot-rolled to a thickness of 2.5 mm. Specifically, rough rolling and finish rolling were conducted as hot rolling to yield hot-rolled sheets having a thickness of 2.5 mm. Finish temperatures of the rough rolling and finish temperatures of the finish rolling are shown in Table 2. The hot-rolled sheets were directly cold-rolled at a reduction ratio in cold rolling of 60% without intermediate annealing and thereby yielded cold-rolled sheets having a thickness of 1.0 mm.

The cold-rolled sheets were heated at a rate of temperature rise of about 300° C./minute, and at the time when they reached a solution heat treatment temperature of 550° C., they were subjected to a solution heat treatment by holding at this temperature for 5 seconds, and then immediately quenched to room temperature at a cooling rate of 100° C./second or more in a continuous heat treatment system. Within 5 minutes (immediately) after the quenching, the quenched sheets were subjected to a preaging (reheating) treatment of holding at 100° C. for 2 hours. The preaged sheets were gradually cooled at a cooling rate of 0.6° C./hr and thereby yielded sheets in T4 conditions (T4 sheets).

Sample sheets (blank) were cut out from the T4 sheets (aluminum alloy sheets after thermal refining treatment). The sample sheets were left stand at room temperature to undergo natural aging, followed by measurement and evaluation of average grain size, amount of dissolved silicon, amount of dissolved magnesium, and other properties of the sample sheets.

The average grain size, amount of dissolved silicon, and amount of dissolved magnesium of the sample sheets were measured according to the following methods.

Average Grain Size

The average grain size of a sample sheet was evaluated from a sheet surface direction using a SEM-EBSP system. This was conducted at two points including a point in a center part in a thickness direction of the sheet and an optional point in a surface layer locating between the outer most surface and one fourth deep in a thickness direction of the sheet. Examples of the SEM and the EBSP analysis system for use herein are a scanning electron microscope available from JEOL (JEOL JSM5410) and an EBSP analysis system (orientation imaging microscopy; OIM) available from TSL Solutions K.K. The sample sheet was measured in an area of 1000 μm wide and 1000 μm long at a measuring step interval of, for example, 3 μm or less at an orientation difference between grain boundaries of 15 degrees or more.

Amounts of Dissolved Silicon and Dissolved Magnesium

The amounts of solid solutions were determined on a sample sheet after the thermal refining treatment and subsequent natural aging for 15 days. The amounts of solid solutions were determined in the following manner. Specifically, the sample sheet was dissolved in hot phenol, the residue (dispersed particles in the sample) was separated therefrom by filtration using a filter with a mesh pore size of 0.1 μm, and the silicon content and magnesium content of the filtrate were determined through inductively coupled plasma emission spectroscopy (ICP), and the determined silicon and magnesium contents were defined as the amount of dissolved silicon and the amount of dissolved magnesium, respectively. Strictly speaking, these values also include the amounts of silicon and magnesium contained in particles of a size of 0.1 μm or less.

As properties of a sample sheet, ridging mark resistance, 0.2% yield strength (AS yield strength: MPa), and 0.2% yield strength after an artificial aging treatment (yield strength after bake hardening: MPa) were determined on a sample sheet after the thermal refining treatment and subsequent 15-day natural aging. In addition, bendability was analyzed. These properties were determined according to the following methods.

Ridging Mark Resistance

The ridging mark resistance of a product aluminum alloy sheet can be determined even before subjecting to press forming and painting (coating). Specifically, surface roughness Ra of a sample sheet was measured after a tensile test in which the sample sheet was stretched 15% in a direction perpendicular to the rolling direction. A sample sheet having a surface roughness Ra after 15% stretch of 10 μm or less was evaluated as being excellent in ridging mark resistance during forming.

The surface roughness Ra (arithmetic average roughness) of the sample sheet was determined by measuring roughness (protrusions and depressions) of the surface of the sample sheet with a stylus surface profilometer according to the definition and measuring method specified in JIS B0601.

The tensile test for imparting stretch was carried out in the following manner. Specifically, a No. 5 test piece according to JIS Z2201 [25 mm wide, 50 mm GL (gage length), and 2.5 mm thick] was sampled from the aluminum alloy sheet after the thermal refining treatment and subsequent 15-day natural aging, and the test piece was stretched at room temperature. The test piece was sampled in a direction perpendicular to the rolling direction, and the tensile direction was a direction perpendicular to the rolling direction. The tensile test was conducted at stretch rate of 5 mm/minute unless the sample showed a 0.2% yield strength and at a stretch rate of 20 mm/min thereafter.

For supporting the determination of ridging mark resistance through stretching, orange peel surfaces were observed. Specifically, the aluminum alloy sheet after the thermal refining treatment and subsequent 15-day natural aging was subjected to draw forming and thereby yielded a formed article, and the presence or absence of orange peel surfaces on entire surface of the formed article was visually observed. A sample having no orange peel surfaces was evaluated as excellent, one having some but partially and small orange peel surfaces was evaluated as good, and one having large orange peel surfaces on the entire surface was evaluated as poor in ridging mark resistance.

The draw forming was conducted as follows. Specifically, a test piece having a diameter of 100 mm was prepared through punching from the sample sheet after the thermal refining treatment and subsequent 15-day natural aging. The test piece was formed into a cup with an Erichsen tester using a 50% dilution of Castrol Sample No. 700 (trade name; Castrol Ltd.) as a lubricant. The draw forming was conducted using a punch having a diameter of 50 mm and shoulder radius R of 4.5 mm, and a die having a diameter of 65.1 mm and a shoulder radius R of 14 mm at a blank holding force of 500 kgf and a drawing ratio of 2 (drawing rate of 50%).

AS Yield Strength

A No. 5 test piece according to JIS Z2201 [25 mm wide, 50 mm GL (gage length), and 2.5 mm thick] was sampled from an aluminum alloy sheet immediately after the thermal refining treatment. The test piece was sampled in a direction perpendicular to the rolling direction and subjected to a tensile test at room temperature. The room-temperature tensile test was carried out at room temperature of 20° C. according to JIS Z2241 (1980) (tensile test method for metal materials).

The tensile test was conducted at a constant crosshead speed of 5 mm/minute until the test piece was broken. Thus, 0.2% yield strength was determined according to this method, and this was defined as "AS yield strength" as the average of five test pieces (N=5).

Yield Strength After Bake Hardening

For evaluating artificial aging capability (bake hardenability), a test piece was prepared by subjecting a sample aluminum alloy sheet to a simulative step of press forming into a panel, and yield strength after bake hardening of the test piece was determined. Specifically, 2% strain was previously applied to the No. 5 test piece according to JIS Z2201, and the test piece was subjected to an artificial aging treatment at a low temperature of 170° C. for a short period of time of 20 minutes. The treated test piece was subjected to a room-temperature tensile test under the conditions as above, 0.2% yield strength of the test piece was determined, and this was defined as the yield strength after bake hardening (MPa). The tensile direction in the test was in parallel with the rolling direction. A sample having a yield strength after bake hardening of 190 MPa or more was evaluated as having good bake hardenability.

Bendability

A bending test piece having a length of 150 mm and a width of 30 mm was sampled from the sample sheet after the thermal refining treatment and subsequent 15-day natural aging. The test piece was subjected to a flat hemming simulating an automotive outer panel, and bendability thereof was evaluated. Specifically, the bending test piece was subjected to a 180-degree tight bending with an inner bending radius R of about 0.25 mm after applying 10% pre-strain. How cracking occurred in the periphery of the test piece after bending was visually observed, and the bendability was evaluated in five rates according to the following criteria:

0: The test piece shows neither orange peel surfaces nor crack.

1: The test piece shows slight orange peel surfaces but no crack.

2: The test piece shows some orange peel surfaces but no crack (even no fine crack).

3: The test piece shows fine cracks.

4: The test piece shows a large crack but not to the extent as defined in Rank 5.

5: The test piece shows two or more large cracks.

A sample having a bendability of Ranks 0 to 2 was acceptable as an automotive outer panel, and one having a bendability of Ranks 3 to 5 was not acceptable. In this test, an inner panel was not inserted into a hem, for assuming that a very thin inner panel was sandwiched between the hem.

Aged Deterioration in Properties Through Natural Aging: Evaluation Through Bendability A sample sheet was cut out from the T4 sheet (aluminum alloy sheet after thermal refining treatment) and subjected to natural aging (being left at room temperature) for three months. Bendability of the sample sheet after the thermal refining treatment and subsequent 3-month natural aging was determined. The bendability herein was determined in a similar manner as in the evaluation of bendability. Specifically, a bending test piece having a length of 150 mm and a width of 30 mm was cut out from the sample sheet after 3-month natural aging and subjected to a 180-degree tight bending with an inner bending radius R of about 0.25 mm after applying 10% pre-strain. The bendability was rated in five rates as in the evaluation of bendability.

The results are shown in Tables 3 and 4. Tables 1 to 4 demonstrate as follows. Samples as Comparative Examples (Samples Nos. 10 to 17) are inferior in one or more of the ridging mark resistance during forming, yield strength after bake hardening, bendability after thermal refining treatment and subsequent 15-day natural aging, and bendability after thermal refining treatment and subsequent 3-month natural aging. Some of them show significant aged deterioration in bendability through natural aging. The aged deterioration in bendability herein was evaluated through the difference between the bendability after thermal refining treatment and subsequent 3-month natural aging and the bendability after thermal refining treatment and subsequent 15-day natural aging, or through the ratio of this difference to the bendability after thermal refining treatment and subsequent 15-day natural aging.

Specifically, Sample No. 10 does not have a surface roughness Ra after 15% stretch of 10 μm or less and thereby is insufficient in ridging mark resistance during forming. This sample has excellent bendability of Rate 1 after thermal refining treatment and subsequent 15-day natural aging but poor bendability of Rate 3 after thermal refining treatment and subsequent 3-month natural aging. In addition, the sample shows large aged deterioration in bendability through natural aging [(3−1)/1=2].

Sample No. 11 has an insufficient yield strength after bake hardening of less than 190 MPa. Samples Nos. 12 and 13 have an insufficient yield strength after bake hardening of less than 190 MPa, show poor bendability of Rate 3 after thermal refining treatment and subsequent 3-month natural aging, and show large aged deterioration in bendability through natural aging [(3−1)/1=2]. Sample No. 14 has an insufficient yield strength after bake hardening of less than 190 MPa, has a surface roughness Ra after 15% stretch of more than 10 μm, and thereby show poor ridging mark resistance during forming. This sample also evaluated as having poor ridging mark resistance, because the formed article surface after draw forming was evaluated as "poor" and shows orange peel surfaces on the entire surface. Sample No. 15 shows poor bendability of Rate 4 after thermal refining treatment and subsequent 3-month natural aging. Samples Nos. 16 and 17 shows poor bendability of Rate 3 after thermal refining treatment and subsequent 15-day natural aging and poor bendability of Rate 5 after thermal refining treatment and subsequent 3-month natural aging. Of Samples Nos. 16 and 17, Sample No. 17 is also insufficient in ridging mark resistance during forming.

In contrast, samples as Examples of the present invention (Samples Nos. 1 to 9) are excellent in all ridging mark resistance during forming, yield strength after bake hardening, bendability after thermal refining treatment and subsequent 15-day natural aging, and bendability after thermal refining treatment and subsequent 3-month natural aging. In addition, they show little aged deterioration in bendability through natural aging.

Specifically, the samples as Examples of the present invention each have a surface roughness Ra after 15% stretch of 10 μm or less; yield an excellent surface of a draw-formed article without any orange peel surfaces or a good surface of a draw-formed article with some but partially and small orange peel surfaces; have good ridging mark resistance; and show a good yield strength after bake hardening of 190 MPa or more. In addition, they show excellent bendability of Rate 1 after thermal refining treatment and subsequent 15-day natural aging. Except for a part (Sample No. 8) of them, they show excellent bendability of Rate 2 after thermal refining treatment and subsequent 3-month natural aging, and these show little aged deterioration in bendability through natural aging [(2−1)/1=1]. Sample No. 8 shows bendability of Rate 2.5 after thermal refining treatment and subsequent 3-month natural aging, which is between Rate 2 and Rate 3. The bendability herein is evaluated near to Rate 2, may not be clearly said as being unacceptable, and is evaluated as acceptable. Of samples as Examples of the present invention, Samples Nos. 1, 2, and 4 show specifically excellent ridging mark resistance.

TABLE 1

| Category | Composition | Mg | Si | Mn | Cu | Fe | Cr | Zr | Ti | Zn | V | Ag | B | Al |
|---|---|---|---|---|---|---|---|---|---|---|---|---|---|---|
| Example | A | 0.55 | 1.1 | 0.07 | 0.001 | 0.15 | — | — | — | — | — | — | — | remainder |
| Example | B | 0.55 | 1.1 | 0.05 | 0.001 | 0.15 | 0.04 | — | — | — | — | — | — | remainder |
| Example | C | 0.4 | 1.4 | 0.2 | 0.01 | 0.1 | — | — | — | — | — | — | — | remainder |
| Example | D | 0.5 | 0.6 | 0.03 | 0.001 | 0.2 | — | — | — | — | — | — | — | remainder |
| Example | E | 0.55 | 1.05 | 0.07 | 0.001 | 0.15 | 0.02 | 0.01 | 0.01 | 0.01 | — | — | 0.001 | remainder |
| Example | F | 0.55 | 1.1 | 0.06 | 0.6 | 0.17 | 0.05 | 0.03 | 0.02 | 0.04 | — | — | 0.002 | remainder |
| Example | G | 0.6 | 1.1 | 0.01 | 0.001 | 0.15 | 0.02 | 0.01 | 0.01 | 0.01 | 0.01 | 0.01 | 0.001 | remainder |
| Comparative Example | H | 0.3 | 1.1 | 0.07 | 0.001 | 0.15 | — | — | — | — | — | — | — | remainder |
| Comparative Example | I | 1.1 | 1.1 | 0.07 | 0.001 | 0.15 | — | — | — | — | — | — | — | remainder |
| Comparative Example | J | 0.5 | 0.4 | 0.07 | 0.001 | 0.15 | — | — | — | — | — | — | — | remainder |
| Comparative Example | K | 0.5 | 1.6 | 0.07 | 0.001 | 0.15 | — | — | — | — | — | — | — | remainder |
| Comparative Example | L | 0.55 | 1.1 | 1.1 | 0.001 | 0.15 | — | — | — | — | — | — | — | remainder |
| Comparative Example | M | 0.55 | 1.1 | 0.06 | 1.1 | 0.15 | — | — | — | — | — | — | — | remainder |

Unit: percent by mass

TABLE 2

| | | | | Hot rolling conditions | | | | |
|---|---|---|---|---|---|---|---|---|
| Category | Sample No. | Composition | Homogenization | Start temperature of rough rolling (° C.) | Finish temperature of rough rolling (° C.) | Time of rough rolling (min) | Finish temperature of finish rolling (° C.) | Thickness of sheet (mm) |
| Example | 1 | A | double | 400 | 390 | 8.5 | 300 | 2.5 |
| Example | 2 | A | double | 480 | 425 | 7.2 | 322 | 2.5 |
| Example | 3 | A | double | 400 | 360 | 9.2 | 298 | 2.5 |
| Example | 4 | B | double | 400 | 395 | 7.1 | 299 | 2.5 |
| Example | 5 | C | double | 400 | 388 | 6.5 | 295 | 2.5 |
| Example | 6 | D | double | 400 | 380 | 6.7 | 290 | 2.5 |
| Example | 7 | E | double | 400 | 394 | 8.6 | 298 | 2.5 |
| Example | 8 | F | double | 400 | 392 | 9.2 | 303 | 2.5 |
| Example | 9 | G | double | 400 | 399 | 9.5 | 305 | 2.5 |
| Comparative Example | 10 | A | single | 530 | 480 | 15.5 | 310 | 2.5 |
| Comparative Example | 11 | A | double | 400 | 399 | 16.1 | 303 | 2.5 |
| Comparative Example | 12 | H | double | 400 | 390 | 8.3 | 303 | 2.5 |
| Comparative Example | 13 | I | double | 400 | 392 | 7.9 | 310 | 2.5 |
| Comparative Example | 14 | J | double | 400 | 400 | 7.5 | 297 | 2.5 |
| Comparative Example | 15 | K | double | 400 | 400 | 8.3 | 297 | 2.5 |
| Comparative Example | 16 | L | double | 400 | 394 | 7.9 | 302 | 2.5 |
| Comparative Example | 17 | M | double | 400 | 396 | 8.6 | 320 | 2.5 |

TABLE 3

| | | Average grain size in final sheet | | Solid solutions in final sheet | | |
|---|---|---|---|---|---|---|
| Category | Sample No. | Surface layer of sheet (μm) | Center part of sheet (μm) | Amount of dissolved Si (%) | Amount of dissolved Mg (%) | Dissolved Si/dissolved Mg |
| Example | 1 | 40 | 42 | 0.63 | 0.45 | 1.4 |
| Example | 2 | 33 | 43 | 0.66 | 0.43 | 1.5 |
| Example | 3 | 33 | 47 | 0.62 | 0.39 | 1.6 |
| Example | 4 | 31 | 37 | 0.65 | 0.44 | 1.5 |
| Example | 5 | 33 | 44 | 0.60 | 0.32 | 1.9 |
| Example | 6 | 31 | 39 | 0.50 | 0.40 | 1.3 |

TABLE 3-continued

| Category | Sample No. | Average grain size in final sheet: Surface layer of sheet (μm) | Average grain size in final sheet: Center part of sheet (μm) | Solid solutions in final sheet: Amount of dissolved Si (%) | Solid solutions in final sheet: Amount of dissolved Mg (%) | Dissolved Si/dissolved Mg |
|---|---|---|---|---|---|---|
| Example | 7 | 35 | 37 | 0.65 | 0.43 | 1.5 |
| Example | 8 | 30 | 38 | 0.65 | 0.40 | 1.6 |
| Example | 9 | 32 | 40 | 0.63 | 0.48 | 1.3 |
| Comparative Example | 10 | 41 | 45 | 0.90 | 0.42 | 2.1 |
| Comparative Example | 11 | 43 | 46 | 0.44 | 0.43 | 1.0 |
| Comparative Example | 12 | 35 | 39 | 0.58 | 0.28 | 2.1 |
| Comparative Example | 13 | 34 | 40 | 0.62 | 0.84 | 0.7 |
| Comparative Example | 14 | 40 | 42 | 0.30 | 0.40 | 0.8 |
| Comparative Example | 15 | 36 | 41 | 0.78 | 0.40 | 2.0 |
| Comparative Example | 16 | 38 | 42 | 0.60 | 0.40 | 1.5 |
| Comparative Example | 17 | 37 | 39 | 0.65 | 0.45 | 1.4 |

TABLE 4

| Category | Sample No. | 15-Day natural aging: AS yield strength (MPa) | 15-Day natural aging: Yield strength after bake hardening (MPa) | 15-Day natural aging: Bendability (Rate) | 3-Month natural aging Bendability (Rate) | Ridging mark resistance: Surface roughness after 15% stretch (μm) | Ridging mark resistance: Orange peel surfaces after draw forming |
|---|---|---|---|---|---|---|---|
| Example | 1 | 119 | 192 | 1 | 2 | 4 | Excellent |
| Example | 2 | 121 | 193 | 1 | 2 | 5 | Excellent |
| Example | 3 | 120 | 195 | 1 | 2 | 7 | Good |
| Example | 4 | 112 | 192 | 1 | 2 | 5 | Excellent |
| Example | 5 | 110 | 191 | 1 | 2 | 7 | Good |
| Example | 6 | 109 | 190 | 1 | 2 | 8 | Good |
| Example | 7 | 116 | 196 | 1 | 2 | 7 | Good |
| Example | 8 | 119 | 198 | 1 | 2.5 | 9 | Good |
| Example | 9 | 125 | 210 | 1 | 2 | 6 | Good |
| Comparative Example | 10 | 115 | 201 | 1 | 3 | 11 | Good |
| Comparative Example | 11 | 110 | 171 | 1 | 2 | 4 | Good |
| Comparative Example | 12 | 101 | 168 | 1 | 3 | 7 | Good |
| Comparative Example | 13 | 101 | 175 | 1 | 3 | 6 | Good |
| Comparative Example | 14 | 98 | 155 | 1 | 2 | 11 | Poor |
| Comparative Example | 15 | 116 | 191 | 2 | 4 | 9 | Good |
| Comparative Example | 16 | 112 | 191 | 3 | 5 | 9 | Good |
| Comparative Example | 17 | 123 | 203 | 3 | 5 | 15 | Good |

As has been described above, aluminum alloy sheets according to embodiments of the present invention are excellent in room temperature stability, resistant to deterioration in properties through natural aging, and are thereby suitably usable typically as automotive outer panels.

What is claimed is:

1. An aluminum alloy sheet as an Al—Mg—Si aluminum alloy sheet which comprises: 0.35 to 1.0 percent by mass of magnesium (Mg); 0.5 to 1.5 percent by mass of silicon (Si); 0.01 to 1.0 percent by mass of manganese (Mn); and 0.001 to 1.0 percent by mass of copper (Cu), with the remainder being aluminum (Al) and inevitable impurities, wherein the amount of dissolved silicon (Si) is 0.55 to 0.80 percent by mass, wherein the amount of dissolved magnesium (Mg) is 0.35 to 0.60 percent by mass, and wherein the ratio of the amount of dissolved silicon (Si) to the amount of dissolved magnesium (Mg) is 1.1 to 2.

2. The aluminum alloy sheet according to claim 1, as an excess-silicon Al—Mg—Si aluminum alloy sheet having a ratio by mass of the silicon content to the magnesium content of 1 or more.

3. The aluminum alloy sheet according to claim 1, which comprises, as the inevitable impurities, 1.0 percent by mass or less of iron (Fe); 0.3 percent by mass or less of chromium (Cr); 0.3 percent by mass or less of zirconium (Zr); 0.3 percent by mass or less of vanadium (V); 0.1 percent by mass or less of titanium (Ti); 0.2 percent by mass or less of silver (Ag); and 1.0 percent by mass or less of zinc (Zn).

4. The aluminum alloy sheet according to claim 1, which comprises 0.005 to 0.2 percent by mass of titanium (Ti) with or without 0.0001 to 0.05 percent by mass of boron (B).

5. The aluminum alloy sheet according to claim 1, as an aluminum alloy sheet produced by homogenizing an aluminum alloy ingot, cooling the homogenized ingot, reheating the cooled ingot, hot rolling the reheated ingot, and cold rolling the hot-rolled product without annealing.

6. The aluminum alloy sheet according to claim 5, wherein rough rolling in the hot rolling is carried out at a start temperature of 490° C. to 380° C. and a finish temperature of 430° C. to 350° C. for 10 minutes or less.

7. A method of using an aluminum sheet, the method comprising forming the aluminum alloy sheet of claim 1 to produce an automotive outer panel.

8. The aluminum alloy sheet according to claim 1, wherein the sheet comprises 0.01 to 0.15 percent by mass of manganese (Mn).

9. The aluminum alloy sheet according to claim 1, wherein the sheet has a yield strength in a range of from 170 MPa to 210 MPa.

10. An aluminum alloy sheet consisting of 0.35 to 1.0 percent by mass of magnesium (Mg);

0.5 to 1.5 percent by mass of silicon (Si);

0.01 to 1.0 percent by mass of manganese (Mn);

0.001 to 1.0 percent by mass of copper (Cu);

1.0 percent by mass or less of iron (Fe);

0.3 percent by mass or less of chromium (Cr);

0.3 percent by mass or less of zirconium (Zr);

0.3 percent by mass or less of vanadium (V);

0.1 percent by mass or less of titanium (Ti);

0.2 percent by mass or less of silver (Ag); and 1.0 percent by mass or less of zinc (Zn), with the remainder being aluminum (Al) and inevitable impurities, wherein the amount of dissolved silicon (Si) is 0.55 to 0.80 percent by mass;

the amount of dissolved magnesium (Mg) is 0.35 to 0.60 percent by mass; and the ratio of the amount of dissolved silicon (Si) to the amount of dissolved magnesium (Mg) is 1.1 to 2.

11. An aluminum alloy sheet consisting of 0.35 to 1.0 percent by mass of magnesium (Mg);

0.5 to 1.5 percent by mass of silicon (Si);

0.01 to 1.0 percent by mass of manganese (Mn);

0.001 to 1.0 percent by mass of copper (Cu);

1.0 percent by mass or less of iron (Fe);

0.3 percent by mass or less of chromium (Cr);

0.3 percent by mass or less of zirconium (Zr);

0.3 percent by mass or less of vanadium (V);

0.005 to 0.2 percent by mass of titanium (Ti) with or without 0.0001 to 0.05 percent by mass of boron (B);

0.2 percent by mass or less of silver (Ag); and 1.0 percent by mass or less of zinc (Zn), with the remainder being aluminum (Al) and inevitable impurities, wherein the amount of dissolved silicon (Si) is 0.55 to 0.80 percent by mass;

the amount of dissolved magnesium (Mg) is 0.35 to 0.60 percent by mass; and the ratio of the amount of dissolved silicon (Si) to the amount of dissolved magnesium (Mg) is 1.1 to 2.

* * * * *